United States Patent [19]

Kozono et al.

[11] Patent Number: 4,909,748

[45] Date of Patent: Mar. 20, 1990

[54] MOVABLE CONNECTOR

[75] Inventors: Seiji Kozono; Toshiro Maejima, both of Shizuoka, Japan

[73] Assignee: Yazaki Corporation, Japan

[21] Appl. No.: 307,482

[22] Filed: Feb. 8, 1989

[30] Foreign Application Priority Data

Feb. 9, 1988 [JP] Japan ..... 63-15096[U]

[51] Int. Cl.[4] ..... H01R 13/64

[52] U.S. Cl. ..... 439/247; 439/248; 439/552

[58] Field of Search ..... 439/246–249, 439/535, 545, 550, 552, 575; 248/27.1, 27.3

[56] References Cited

FOREIGN PATENT DOCUMENTS 59-20578 2/1984 Japan .

1072159 2/1984 U.S.S.R. ..... 439/247

*Primary Examiner*—Eugene F. Desmond

*Attorney, Agent, or Firm*—Wigman & Cohen

[57] ABSTRACT

A movable connector having a movable housing which is to be secured to a panel is provided with spring members on for insertion into a fitting groove formed in the panel. The spring members serve to flexibly absorb displacements caused when a partner housing from a partner connector is fitted to the movable housing.

13 Claims, 3 Drawing Sheets

MOVABLE CONNECTOR

BACKGROUND OF THE INVENTION

1. Field of the Invention

The present invention relates to a movable connector, and more particularly to a movable connector capable of flexible absorbing displacements caused when a partner connector is fitted to the movable connector.

2. Description of the Prior Art

In the prior art of connectors having male and female housings which are automatically connected to each other by machinery, such as when wire harnesses are connected to instrumentation during the assembly of automobiles, it has been suggested in Japanese Laid-Open Utility Model Publication No. 59-20578 that one of the housings be made flexibly movable on a panel to absorb any displacements caused when the two housings are fitted together.

As shown in FIG. 5 of Japanese Laid-Open Utility Model Publication No. 59-20578, a connector proposed for the above-mentioned purpose comprises a male housing and a bracket which is formed separately from the male housing. The bracket has fitting portions, which include flexible engagement arms for flexibly supporting the male housing, and mounting members for securing the male connector to a panel.

In the structure described above, the fitting portions and the mounting members enable the male housing to absorb small positional changes when a female housing is joined thereto. However, since the male housing and the bracket are separately formed and assembled elements, the number of parts that need to be manufactured and assembled is unavoidably increased, which results in increased manufacturing costs and assembly time.

Furthermore, according to the structure above, the overall size of the connector has to be made relatively large, and this results in a more complicated manufacturing process.

SUMMARY OF THE INVENTION

In view of disadvantages of the prior art movable connectors described above, it is an object of the present invention to provide a movable connector having a simple structure which is capable of flexibly absorbing displacements caused when a partner connector is fitted to the movable connector.

It is still another object of the present invention to provide a movable connector having a compact and inexpensively producible means formed directly on the movable connector housings for absorbing displacements caused when a partner connector is fitted to the movable connector.

It is still another object of the present invention to provide a connector which can be easily mounted to a panel.

In order to achieve the above-mentioned objects, the movable connector of the present invention comprises a housing which is flexibly fitable to a panel having an opening formed at a fitting portion thereof. For the purpose of forming a flexible fit with the panel, the housing is provided with first spring members formed around the connector housing for insertion into a fitting groove formed in the edge of the panel defining the opening of the fitting portion.

The first spring members formed around the connector housing are provided so as to flexibly abut the bottom of the fitting groove. In addition, second spring members may be provided so as to abut inside walls of the fitting groove, and fitting flanges may be provided around the connector housing to facilitate insertion of the first and second spring members into the fitting groove.

For standard type, movable connectors having either a male or female housing, the structure of the connector housing according the present invention can be applied to both housings, but the preferred practice would be to apply this structure to the male housing because a connector having male housing is typically the one that is fastened to a panel.

Now, when a connector is provided with the connector housing structure described above, the first spring members enable the connector to flexibly absorb any small displacements occurring in directions parallel to the plane of the panel. If the second spring members are additionally provided, the connector will also be capable of flexibly absorbing any small pivotal displacements occurring with respect to the panel.

Thus, in concert with the objectives stated above, it is possible to provide a movable connector which is capable of flexibly absorbing displacements caused when a partner connector is fitted to the movable connector. Furthermore, since the first and second spring members are formed directly on the movable connector housing, the movable connector can be manufactured as a single part, thereby achieving compactness, low manufacturing costs and decreased assembly time.

The foregoing, and other objects, features, and advantages of the present invention will become more apparent from the detailed description of the preferred embodiments taken in conjunction with the accompanying drawings.

BRIEF DESCRIPTION OF THE DRAWINGS

FIG. 1(*b*) is a perspective view showing the relation between the movable connector of FIG. 1(*a*) and a panel to which the movable connector is to be mounted.

FIG. 3(*b*) is a side sectional view similar to that of FIG. 3(*a*) showing an example of the respective states of the movable and partner connector housings during engagement.

FIG. 3(*c*) is a side sectional view showing the movable and partner connector housings in a state of completed engagement.

DETAILED DESCRIPTION OF THE PREFERRED EMBODIMENTS

Figure 1A:
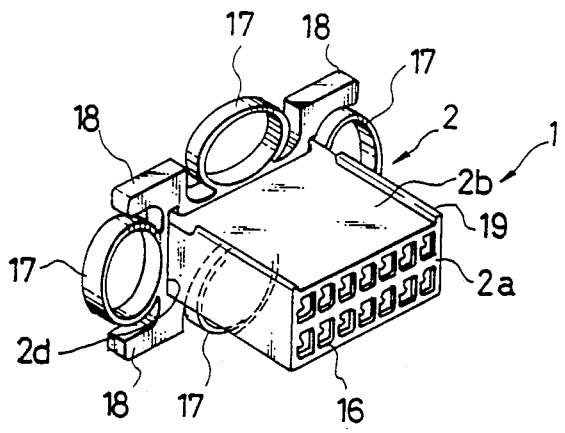
FIG. 1(*a*) is a perspective view of a movable connector according to a first embodiment of the present invention.
Figure 1B:
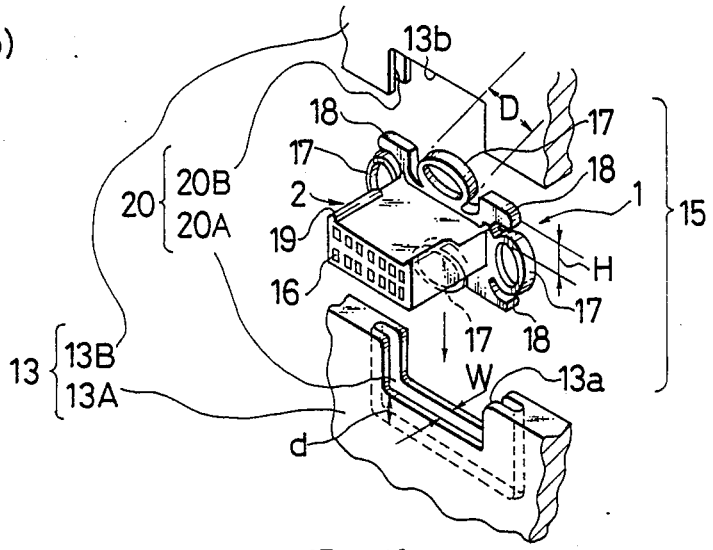

With reference to FIGS. 1(*a*) and 1(*b*), a first embodiment of the present invention will be described.

Namely, as shown in FIG. 1(*a*), a movable connector 1 comprises a male housing 2 engageable with a female housing of a partner connector (not shown). The male housing 2 is formed from a synthetic resin and has a basic structure resembling that of a rectangular block, with front and rear ends and four faces, and, accordingly, has a rectangular shape in cross section.

At a front end 2*a* of the male housing 2 there are a plurality of terminal receiving chambers 16, each of which houses a female terminal (not shown) engagable with a corresponding male terminal (not shown) of the female housing of the partner connector. Integrally formed around the male housing 2 at a rear portion 2*d* thereof are four annular spring members 17, each extending from different faces of the male housing 2, and integrally formed between every two adjacent annular spring members 17 is a fitting flange 18.

The annular spring members 17 are formed essentially as circles or ellipses, and the diameter D of each annular spring member 17 measured along a line normal to the respective face of the male housing 2 is set to be larger than the height H of the portions of adjacent fitting flanges 18 extending along lines normal to the same face of the male housing 2, such that the height of the annular spring member 17 on each face is higher than the height H of the adjacent fitting flanges 18.

On a top face 2*b* of the male housing 2, there are additionally provided a guide members 19 for slide contacting a guide groove (not shown) formed in an inside surface of the female housing of the partner connector, by which it is possible to confirm a proper orientation of the female housing with respect to the male housing 2 when engagement takes place.

Now, with reference to FIG. 1(*b*), a panel 13 for holding the male housing 2 comprises a fixed panel 13A and a fitting panel 13B which is fastenable to the fixed panel 13A by screws or the like. The panels 13A and 13B are provided, respectively, with opposing C-shaped notch portions 13*a* and 13*b* which, upon the fastening of the fitting panel 13B to the fixed panel 13A, form a closed rectangular space defining the opening portion 15. The opening portion 15 is preferably made to have dimensions slightly larger than those of a cross section of the male housing 2 taken along a plane perpendicular to the faces thereof.

Along the inside edges of the panels 13A and 13B that define the notch portions 13*a* and 13*b* are formed fitting grooves 20A and 20B, respectively. The fitting grooves 20A and 20A are formed so as to be in alignment with each other in order to define a single rectangular fitting groove 20 when the panels 13A and 13B are fastened together. The depth "d" of the fitting groove 20 is set to be between the diameter D of the annular spring members 17 and the height H of the fitting flanges 18 so as to allow flexibility of the annular spring members 17, and the width "w" of the fitting groove 20 is set to be substantially the same as the width of the annular spring members 17.

In fitting the male housing 2 to the panel 13, a half portion of the annular spring members 17 and fitting flanges 18 surrounding the male housing 2 is inserted into the fitting groove 20A of the fixed panel 13A. Next, the fitting panel 13B is fitted over the male housing 2 in such a manner that the remaining half portion of the annular spring members 17 and fitting flanges 18 become inserted into the fitting groove 20B of the fitting panel 13B. Then, after the panels 13A and 13B have been fastened together by the previously mentioned fastening means, the annular spring members 17 and fitting flanges 18 will completely reside within the fitting groove 20, with the annular spring members 17 flexibly abutting the bottom of the fitting groove 20.

In the structure described above, since the annular spring members 17 are in flexible abutment with the bottom of the fitting groove 20, the male housing 2 can move flexibly by slight degrees within the plane of the panel 13. The result is that the male housing 2 is capable of absorbing slight displacements occurring parallel to the plane of the panel 13 caused when the female housing is fitted to the male housing 2.

Figure 2:
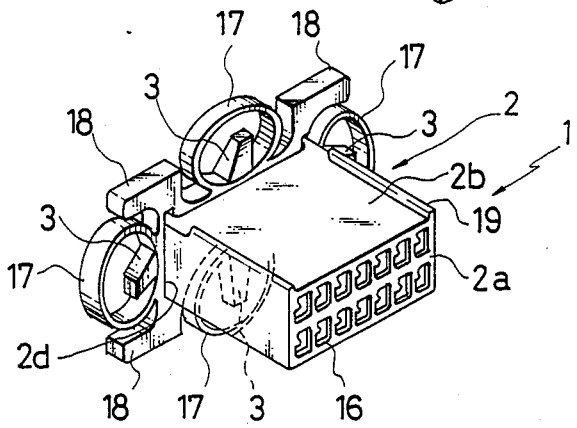
FIG. 2 is a perspective view of a movable connector structure according to a second embodiment of the present invention.
Figure 3A:
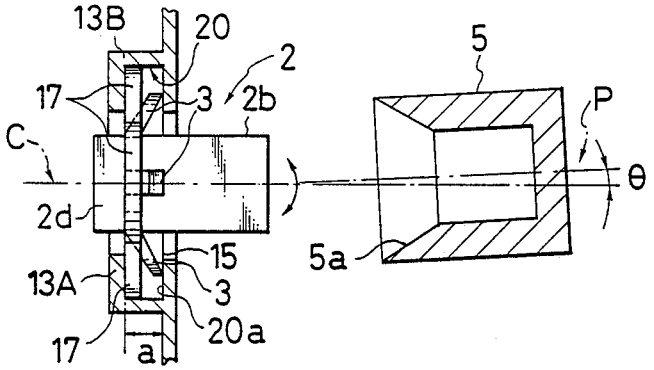
FIG. 3(*a*) is a side sectional view showing an example of the state of a partner connector housing with respect to the movable connector housing of FIG. 2 just before engagement occurs.
Figure 3B:
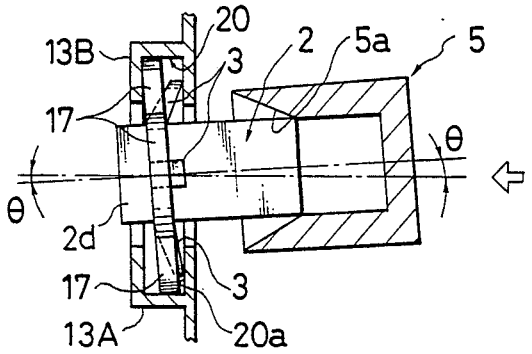
Figure 3C:
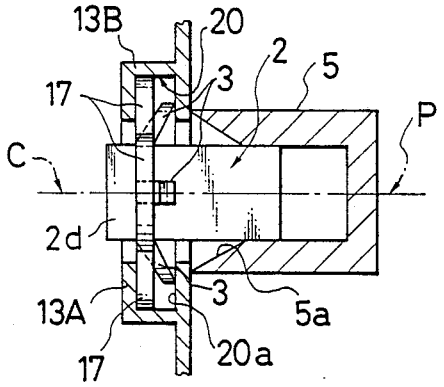
Figure 4A:
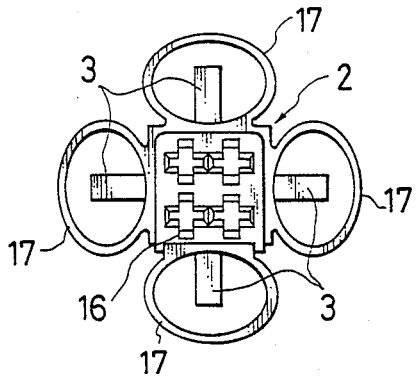
FIGS. 4(*a*), 4(*b*) and 4(*c*) are front views showing, respectively, movable connector housings of third, fourth, and fifth embodiments of the present invention.
Figure 4B:
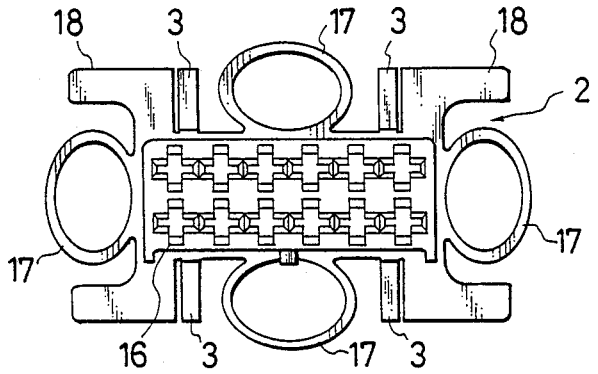
Figure 4C:
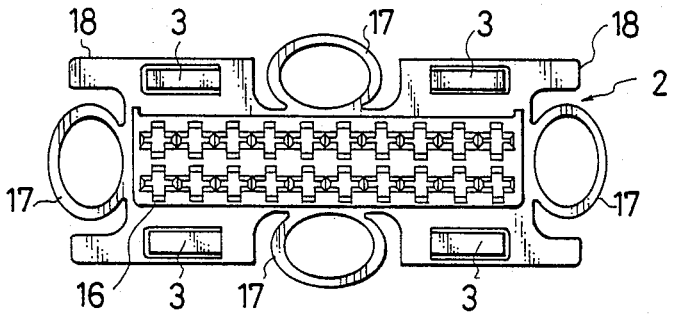

With reference now to FIGS. 2–4, a second embodiment of the present invention will be described, and in order to avoid redundancy in this description, unless otherwise indicated, all reference numbers and marks used in these drawings will indicate the same elements, spaces, portions, grooves and dimensions shown in FIGS. 1(*a*) and 1(*b*). Now, as shown in FIG. 2, the male housing 2 is additionally provided with a plurality of wedge-shaped spring members 3 formed in the vicinity of the annular spring members 17. The wedge-shaped spring members 3 are integrally formed on the side faces of the male housing 2 so as to extend in a direction toward the front end 2*a* thereof.

Next, as shown in FIGS. 3(*a*)-(*c*), the panel 13 used for supporting the connector 1 is substantially the same in all respects as that shown in FIG. 1(*a*), except that the fitting groove 20 of the panel 13 shown in FIGS. 3(*a*)-3(*c*) has a width "a" that is larger than the width "w" of the panel shown in FIG. 1(*a*). The width "a" of the fitting groove 20 is set so as to allow the insertion of the annular spring members 17, the wedge-shaped spring members 3 and the fitting flanges 18.

Ater the male housing 2 has been fitted to the panel 13 (carried out by using the same steps as those for fitting the male housing of the first embodiment to the panel shown in FIG. 1(*a*)), the annular spring members 17 will be in flexible abutment with the bottom of the fitting groove 20, and the wedge-shaped spring members 3 will be in flexible abutment with the side wall 20*a* of the fitting groove 20. These abutment states are best understood with reference to FIG. 3(*a*).

In the structure of the second embodiment described above, the annular spring members 17 enable the male housing 2 to absorb small displacements occurring in directions parallel to the plane of the panel 13 by virtue of their flexible compressibility against the bottom of the fitting groove 20. Likewise, the flexible compressibility of the wedge-shaped spring members 3 against the side wall 20*a* of the fitting groove 20 will enable the male housing 2 to absorb any small pivotal displacements occurring with respect to the panel.

To gain a better understanding of the two types of displacements that are flexibly absorbed by the connector, an example of how the annular and wedge-shaped spring members of the connector function when a partner connector is fitted to the movable connector is shown in FIGS. 3(*a*)-(*c*).

In FIG. 3(*a*) a a partner connector having a female housing 5 is shown in its approach to the male housing 2 at an instant just before engagement of the two housings occurs. As indicated, the female housing 5 is approaching the male housing 2 along a line of approach P that is angularly displaced by an angle $\theta$ with respect to the axis C of the male housing 2. In this drawing the male housing 2 is shown in its normal state in which its axis C is orthogonal to the plane of the panel 13.

Then, as shown in FIG. 3(*b*), when guide portions 5*a* of the female housing 5 abut the front edge of the male housing 2, the annular and wedge-shaped spring members 17 and 3 become compressed and allow the male housing 2 to flexibly align itself with the female housing 5, such that the axis C of the male housing 2 lies along the line P. Alignment occurs because the male housing 2 is flexibly displaced with respect to the plane of the panel 13, and flexibly pivoted with respect to the center of the rear portion 2*d* of the male housing 2. These flexible positional and pivotal displacements result, respectively, from the components of force acting parallel to the plane of the panel being absorbed by the compression of the annular spring members 17 against the bottom of the fitting groove 20, and from the components of force acting along a curved path non-parallel to the plane being absorbed by the compression of the wedge-shaped spring members 3 against the side wall 20*a* of the fitting groove 20.

Finally, as shown in FIG. 3(*c*), after the female housing 5 has been completely engaged with the male housing 2, and after all externally acting forces are no longer present, the annular and wedge-shaped spring members 17 and 3 will restore the male housing 2, and consequently the movable connector 1, to its normal position in which the axis C of the male housing 2 is once more orthogonal to the plane of the panel 13.

With reference to FIGS. 4(*a*)-4(*c*), respectively, the pertinent elements of third fourth and fifth embodiments of the present invention are shown.

In FIG. 4(*a*), the male housing 2 of the third embodiment is shown having a square shape in cross section, and the annular and wedge-shaped spring members 17 and 3 are provided in the same manner as for the first embodiment. However, in this embodiment there is no provision of fitting flanges.

In FIG. 4(*b*), the male housing 2 of the fourth embodiment is shown having a rectangular cross section similar to that of the first embodiment. However, in this embodiment the wedge-shaped spring members 3 are somewhat displaced from the annular spring members 17, and they are provided on only two faces of the male housing 2 between the annular spring members 17 and the fitting flanges 18.

In FIG. 4(*c*), the male housing 2 of the fifth embodiment is shown having a rectangular cross section longer than that of the first embodiment, and for this embodiment the wedge-shaped spring members 3 are formed within the fitting flanges 18.

For the third, fourth and fifth embodiments described above, the male housing 2 functions in substantially the same way as the male housing 2 of the first and second embodiments, and therefore a repeat description of such functions shall be omitted.

Lastly, it is to be understood that even though the present invention has been described in its preferred embodiments, many modifications and improvements may be made without departing from the scope of the invention as defined in the appended claims.

What is claimed is:

1. A movable connector having a movable housing to which a partner housing of a partner connector is fitted after the movable housing has been mounted to a panel, comprising:

means formed on the movable housing for flexibly absorbing positional displacement of the movable connector within a plane perpendicular to the fitting direction of the partner housing to the movable housing when the partner housing is fitted to the movable housing, wherein the panel includes an opening and a fitting groove formed around the opening, the fitting groove having a bottom section, and the positional displacement absorbing means comprises spring members which flexibly abut the bottom section of the fitting groove when the movable housing is mounted to the panel.

2. The movable connector of claim 1, wherein each spring member comprises an annular spring, each annular spring having a central hollow space that allows the annular spring to flexibly deform against the bottom section of the fitting groove when the partner housing is fitted to the movable housing.

3. The movable connector of claim 2, further comprising fitting flanges formed on the movable housing, the fitting flanges being inserted into the fitting groove of the panel when the movable housing is fitted to the panel.

4. A movable connector having a movable housing to which a partner housing of a partner connector is fitted after the movable housing has been mounted to a panel, comprising:

first means formed on the movable housing for flexibly absorbing positional displacement of the movable connector within a plane perpendicular to the fitting direction of the partner housing to the movable housing when the partner housing is fitted to the movable housing; and second means formed on the movable housing for flexibly absorbing pivotal displacement of the movable connector with respect to the panel when the partner housing is fitted to the movable housing, wherein the panel includes an opening and a fitting groove formed around the opening, the fitting groove having a bottom section, and the first displacement absorbing means comprises first spring members which flexibly abut the bottom section of the fitting groove when the movable housing is mounted to the panel.

5. The movable connector of claim 4, wherein each of the first spring members comprises an annular spring, each annular spring having a central hollow space that allows the annular spring to flexibly deform against the bottom section of the fitting groove when the partner housing is fitted to the movable housing.

6. The movable connector of claim 5, wherein the second displacement absorbing means comprises second spring members.

7. The movable connector of claim 6, further comprising fitting flanges formed on the movable housing, the fitting flanges being inserted into the fitting groove of the panel when the movable housing is fitted to the panel.

8. The movable connector of claim 6, wherein the fitting groove has inner side walls and the second spring members comprise wedge-shaped springs, each wedge-shaped spring having an abutting portion for flexibly abutting one of the side walls of the fitting groove of the panel when the movable housing is secured to the panel.

9. The movable connector of claim 8, further comprising fitting flanges formed on the movable housing, the fitting flanges being inserted into the fitting groove of the panel when the movable housing is fitted to the panel.

10. The movable connector of claim 8, wherein the wedge-shaped springs are provided within the central hollow spaces of the annular springs.

11. The movable connector of claim 9, wherein the wedge-shaped springs are provided within the central hollow spaces of the annular springs.

12. The movable connector of claim 9, wherein the wedge-shaped springs are provided on adjacent sides of at least two of the annular springs.

13. The movable connector of claim 9, wherein the fitting flanges have openings formed therein, and the wedge-shaped springs are formed on the on the fitting flanges so as to extend into the openings thereof.

* * * * *